US010072887B2

(12) United States Patent
Lokhande et al.

(10) Patent No.: US 10,072,887 B2
(45) Date of Patent: Sep. 11, 2018

(54) COMPRESSOR MOUNTING BASE PLATE

(71) Applicant: Dow Global Technologies LLC, Midland, MI (US)

(72) Inventors: Ashishkumar S. Lokhande, Pune (IN); Onkareshwar V. Bijjargi, Pune (IN); Nilesh R. Tawde, Mumbai (IN); Gulab N. Malunjkar, Pune (IN)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/508,183

(22) PCT Filed: Oct. 26, 2015

(86) PCT No.: PCT/US2015/057319
§ 371 (c)(1),
(2) Date: Mar. 2, 2017

(87) PCT Pub. No.: WO2016/069448
PCT Pub. Date: May 6, 2016

(65) Prior Publication Data

US 2017/0241697 A1 Aug. 24, 2017

(30) Foreign Application Priority Data

Oct. 29, 2014 (IN) ..... 5384/CHE/2014

(51) Int. Cl.
*F25D 23/00* (2006.01)
*F25D 21/14* (2006.01)

(52) U.S. Cl.
CPC ..... *F25D 23/006* (2013.01); *F25D 21/14* (2013.01)

(58) Field of Classification Search
CPC ..... F25D 21/14; F25D 2400/38; F25D 23/06
See application file for complete search history.

(56) References Cited

U.S. PATENT DOCUMENTS 4,471,633 A 9/1984 Tinsler
4,497,183 A * 2/1985 Gelbard ..... F25B 31/006 62/279

(Continued)

FOREIGN PATENT DOCUMENTS

WO WO-2009/084181 A1 7/2009

OTHER PUBLICATIONS

PCT/US2015/057319, International Search Report dated May 6, 2016.

(Continued)

*Primary Examiner* — Cassey D Bauer

(57) ABSTRACT

An elongated non-metal, corrosion resistant compressor mounting base plate structure including (I) a base plate segment having a top surface and a bottom surface, wherein the base plate segment is generally rectangular in shape forming two elongated sides opposite each other and two transverse sides opposite each other; and wherein the base plate segment is adapted for receiving a compressor on the top surface of the base plate; (II) a means for receiving and removably affixing a compressor to the top surface of the base plate segment; and (III) a reinforcement means integral with said base plate segment; wherein said reinforcement means includes at least two elongated channel reinforcement segments integral with the base plate segment, one channel reinforcement member at each of the elongated sides of the base plate segment; said reinforcement means being adapted for providing the compressor mounting base plate structure with sufficient strength and rigidity such that the compressor mounting base plate structure can withstand deformation a load from the weight of the compressor; and wherein the compressor mounting base plate structure comprises a non-metal, corrosion resistant structure.

12 Claims, 11 Drawing Sheets

(56) References Cited

U.S. PATENT DOCUMENTS

| | | | | |
|---|---|---|---|---|
| 4,920,696 | A * | 5/1990 | Mawby | F25D 23/006 248/674 |
| 5,711,162 | A * | 1/1998 | Wolanin | F16M 11/42 29/513 |
| 6,341,830 | B1 | 1/2002 | Chun | |
| 7,056,796 | B2 | 6/2006 | Wu | |
| 7,168,260 | B2 | 1/2007 | Lee et al. | |
| 2008/0145595 | A1 | 6/2008 | Pratt et al. | |
| 2010/0181883 | A1 | 7/2010 | Kim et al. | |

OTHER PUBLICATIONS

PCT/US2015/057319, International Preliminary Report on Patentability dated May 2, 2017.
PCT/US2015/057319, Written Opinion of the International Searching Authority dated May 6, 2016.

* cited by examiner

COMPRESSOR MOUNTING BASE PLATE

FIELD

The present invention relates to a compressor mounting base plate for an appliance such as a refrigerator; and more specifically, the present invention relates to a non-metal, corrosion resistant compressor mounting base plate for a refrigerator, and a process for manufacture the compressor mounting base plate. The present invention also relates to a refrigerator installed with the above compressor mounting base plate for a compressor to be mounted thereon.

BACKGROUND

Original equipment manufacturers (OEMs) that manufacture refrigerators are aspiring to shift from the OEMs' current convention design practice of steel stamped refrigerator parts to new technologies in designing and manufacturing of such refrigerator parts. The current trend in the home appliance industry is moving toward a wall-mounted refrigerator which will prompt OEMs to make such products lighter. For example, OEMs are looking to replace the current steel compressor mounting plate of a current refrigerator with a light weight and a corrosion resistance compressor mounting base plate.

Generally, a compressor and the compressor mounting base plate for a refrigerator are located in a machine compartment of the refrigerator at the lower portion or bottom structure of the refrigerator. A compressor mounting base plate is positioned under the rear part of the refrigerator bottom so as to define a machine compartment and the compressor mounting base plate supports a compressor mounted on the base plate located in the machine compartment.

FIGS. 1 and 2 show a conventional design of a refrigerator, generally indicated by numeral 10, illustrating some of the conventional parts of a refrigerator including a conventional steel compressor mounting base plate 11 affixed to the bottom portion of the refrigerator cabin 12 at a lower portion of a refrigerator cabin; and a conventional compressor 13 affixed to the top surface of the compressor mounting base plate 11. The compressor 13 is attached to the top surface of the compressor mounting base plate 11 via threaded bolts 14 and threaded nuts 15; and compressor support member brackets 16 attached to the compressor 13. Disposed in-between the brackets 16 and the surface of the compressor mounting base plate 11 are vibration damping members 17 for attenuating the vibrations of the compressor when the compressor is in operation. In addition, wheels 18 are attached to the compressor mounting base plate 11 to provide the refrigerator with mobility when the compressor mounting base plate 11 is affixed to the refrigerator cabin 12.

FIGS. 3-5 illustrate another example of a conventional steel compressor mounting base plate in the form of a rectangular-shaped tray member generally indicated by numeral 20 which can be affixed to the bottom portion of a refrigerator unit of the prior art (not shown) and which is also adapted for affixing a conventional compressor (not shown) to the top surface of the compressor mounting base plate 21.

A typical compressor mounting plate of the prior art as shown in FIGS. 3-5 is made from 1 millimeter (mm) thick steel sheets. The compressor mounting plate 20 is usually manufactured using a sheet metal stamping process to form the general structure of the base plate 21 having a top surface 22 and a bottom surface 23; and sidewalls 24 and 25. The process of manufacturing the compressor mounting plate can include a secondary operation that can be used to make flange tabs 26, flange holes 27, plate holes 28; and plate holes 29 in the base plate 21. Typically, the compressor mounting plate part is about 1.2 kg in weight. When the steel compressor mounting plate is subjected to a corrosive environment, over time, the steel corrodes and loses its strength. Also, the structural damping coefficient for steel is approximately 2 percent (%) which causes vibrations to transfer to the refrigerator cabin through the compressor mounting plate even though there are typically four rubber dampers 33 fixed with bolts 31 and nuts 32 to the steel sheet plate 21 below the location of where the compressor support member brackets will be positioned. The brackets are not shown in FIGS. 3 and 4 but the brackets can be similar to the brackets 16 of FIGS. 1 and 2. In addition, wheel members 34 are attached to the compressor mounting base plate 21 via a slot 35 and axel rod 36 to provide a refrigerator with mobility when the compressor mounting base plate 21 is affixed to a refrigerator cabin (not shown).

Thus, OEMs in the home appliance industry are continually seeking appliance equipment and parts such as a compressor mounting base plate product for a refrigerator unit that would provide an improvement to the overall manufacture and cost of an appliance such as a refrigerator unit.

SUMMARY

The present invention includes a compressor mounting base plate structure and design for an appliance device which uses a compressor; a motor; or an equivalent vibrating (reciprocating/rotating) apparatus such as a washing machine, a dishwasher, an air-conditioning unit, or a refrigerator unit. The compressor mounting plate exhibits beneficial characteristics which can also be critical customer requirements. For example, the compressor mounting base plate of the present invention can be light weight such that the compressor mounting base plate is from about 20% to about 30% lighter than a steel plate. The compressor mounting base plate of the present invention also can be advantageously manufactured from a non-metal, non-corrosive composite material such as for example a polyurethane polymer.

In one preferred embodiment, for example, the compressor mounting base plate of the present invention includes an elongated non-metal, corrosion resistant compressor mounting base plate structure useful for an appliance such as a refrigerator unit including:

(I) a base plate segment having a top surface and a bottom surface, wherein the base plate segment is generally rectangular in shape forming two elongated sides opposite each other and two transverse sides opposite each other; and wherein the base plate segment is adapted for receiving a compressor on the top surface of the base plate;

(II) a means for receiving and removably affixing a compressor to the top surface of the base plate segment; and (III) a reinforcement means integral with said base plate segment; wherein said reinforcement means includes at least two elongated channel reinforcement segments integral with the base plate segment, one channel reinforcement member at each of the elongated sides of the base plate segment; said reinforcement means being adapted for providing the compressor mounting base plate structure with sufficient strength and rigidity such that the compressor mounting base plate structure can withstand a deformation load from the weight of the compressor; and wherein the compressor mounting base plate structure comprises a non-metal, corrosion resistant structure.

The compressor mounting base plate of the present invention made from a composite material has several advantages over a conventional compressor mounting base plate made from a metal such as steel. For example, the composite-based compressor mounting base plate structure of the present invention: (1) is light weight and up to about 30% lighter in weight compared to a steel compressor mounting base plate; (2) is as strong as a steel compressor mounting base plate; (3) exhibits no corrosion because the composite-based compressor mounting base plate of the present invention is made of a non-corrosive material such as a polyurethane polymer; (4) exhibits increased dynamic response under compressor loading conditions which is beneficial to restrict mechanical vibrations of the compressor during operation in an appliance device such as a refrigerator; and (5) is easily integrated into conventional parts of various appliance devices such as a conventional refrigerator.

Another aspect of the present invention includes a process for manufacturing the compressor mounting base plate having the above described advantages. In one preferred embodiment for example, the process for manufacturing the compressor mounting base plate may include a pultrusion process.

BRIEF DESCRIPTION OF THE DRAWINGS

For the purpose of illustrating the present invention, the drawings show a form of the present invention which is presently preferred. However, it should be understood that the present invention is not limited to the embodiments shown in the drawings.

DETAILED DESCRIPTION

Figure 1:
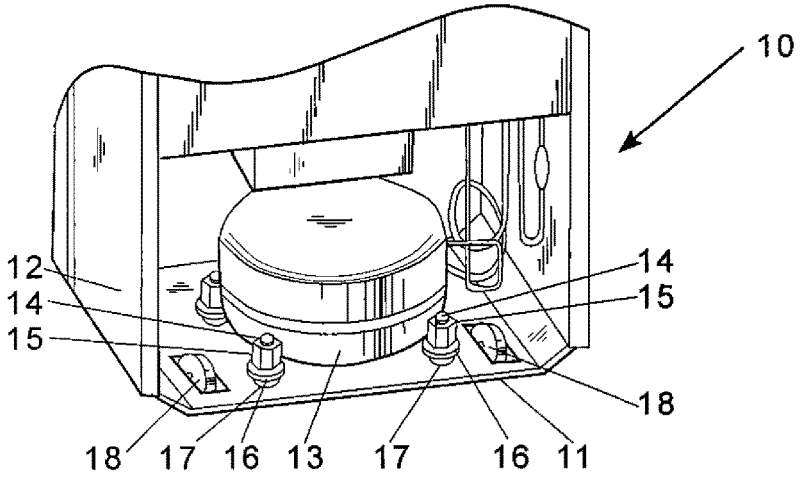
Fig. 1 (PRIOR ART)
FIG. 1 is a perspective view of a back side lower portion of a refrigerator of the prior art showing some parts of a refrigerator including a machine compartment of a refrigerator containing a steel compressor mounting base plate of the prior art installed in the lower portion of the refrigerator, and a compressor of the prior art mounted on the steel compressor mounting base plate.

"Light weight", with reference to a composite compressor mounting base plate, herein means a reduced mass of the composite compressor base plate compared to a conventional steel compressor mounting base plate.

"Dynamic response", with reference to a compressor mounting base plate, herein means the required dynamic stiffness of the compressor mounting base plate sufficient for the compressor mounting base plate to sustain and to isolate vibration of a compressor while providing the required stiffness of the compressor mounting base plate sufficient for the compressor mounting base plate's operation.

"Strong", with reference to a compressor mounting base plate, means the required static stiffness of the compressor mounting base plate sufficient for the compressor mounting base plate to contain/withstand the mass of a compressor.

The composite compressor mounting base plate of the present invention has been developed keeping in mind the above problems occurring in the prior art.

A compressor and a compressor mounting base plate are typically used in refrigerators. A compressor used in refrigerators is an apparatus for compressing a low temperature/low pressure refrigerant into a high temperature/high pressure refrigerant and discharging the high temperature/high pressure refrigerant therefrom. After the discharged refrigerant is heat-radiated to an atmosphere and is changed into the low temperature/low pressure refrigerant via an expansion unit, the low temperature/low pressure refrigerant absorbs heat from inside of the refrigerator.

While the compressor is operated, vibration is generated from the compressor; and the generated vibration is transmitted to other elements of the refrigerator connected to the compressor without damping, thereby causing a noisy vibration to be generated from the whole of the refrigerator through each element of the refrigerator connected to the compressor. Therefore, one objective of the present invention is to provide a compressor mounting base plate structure that advantageously prevents, reduces or attenuates the transmittance of the vibration generated from the compressor through the compressor mounting base plate supporting the compressor and to the refrigerator's main body and frame.

A compressor, used in appliance devices such as refrigerators, also commonly operates in a corrosive environment due to the moisture created by condensation in a machine compartment casing of the refrigerator where the compressor is located. Therefore, another object of the present invention is to provide a compressor mounting base plate structure that is made of a non corrosive synthetic resin material, i.e., a thermosetting composite material.

Another object of the present invention is to provide a compressor mounting base plate structure that is sufficiently strong and capable of withstanding the load conditions of a compressor at the location where the compressor mounting base plate is installed; and thus, preventing deformation of the compressor mounting base plate such as when a heavy compressor is affixed to the compressor mounting base plate.

Another object of the present invention is to provide a compressor mounting base plate structure having improved impact resistance.

The lower portion of a conventional refrigerator typically includes a machine compartment casing (also referred to as a "machine room") made of metal; a conventional compressor made of metal, and a compressor mounting base plate also made of metal. Thus, the total overall weight of the refrigerator unit including the compressor and the compressor mounting base plate is typically very heavy; and the total overall manufacturing cost of the refrigerator unit is quite high. Therefore, a further object of the present invention is to provide a compressor mounting base plate structure that is light weight by fabricating the compressor mounting base plate structure with a light weight composite material. By incorporating such a light weight compressor mounting base plate structure made of composite material into a refrigerator unit, the overall weight of the refrigerator unit can be reduced.

Still another object of the present invention is to simplify the parts of a refrigerator that are disposed in the machine compartment casing located at the lower structure of the refrigerator to thereby reduce manufacturing costs and improve assembly efficiency of the refrigerator. For example, in one embodiment of the present invention the fabrication of the compressor mounting base plate structure is simplified by fabricating a single piece compressor mounting base plate structure using a simple fabrication process such as a pultrusion process, wherein the fabrication costs for fabricating the compressor mounting base plate structure and a refrigerator are reduced.

The present invention compressor mounting base plate structure may be advantageously used as part of a machine compartment casing of a refrigerator wherein the compressor mounting base plate engages the lower portion of a conventional refrigerator and wherein the top surface of the compressor mounting base plate defines the bottom portion of the machine compartment casing of the refrigerator.

With reference to FIGS. 6, 6A, 6B, 6C, and 7-12, there is shown one embodiment of a compressor mounting base plate of the present invention made using a pultrusion process. The compressor mounting base plate structure (herein referred to as "the base plate") includes an elongated, non-metal, non-corrosive structure. The base plate of the present invention, shown in FIGS. 6, 6A-6C and 7-12, is generally indicated by reference numeral 40. The base plate 40 can also be referred to as a tray member (or a pan member).

The base plate 40 includes a combination of a middle or central base plate section or segment 50 (more readily described with reference to FIG. 6); a structural reinforcement means integral with the base plate segment, wherein the structural reinforcement means includes at least a first and second elongated channel reinforcement members integral with the base plate segment; wherein the first and second channel reinforcement members are generally indicated by numerals 60A and 60B, respectively (more readily described with reference to FIG. 6A); and each elongated channel reinforcement member is integrally connected to the base plate segment 50. Optionally, a first supplemental structural reinforcement means including at least a first and second supplemental reinforcing structure members integrally connected to the base plate segment may be used. The first and second supplemental reinforcing structure members are generally indicated by numerals 70A and 70B, respectively (more readily described with reference to FIG. 6B); and each supplemental reinforcing structure member is integrally connected to the base plate segment 50 and integrally connected to the first and second channel reinforcement members 60A and 60B. In another optional embodiment, a second supplemental structural reinforcement means including a third and fourth supplemental reinforcing structure members which are generally indicated by numerals 80A and 80B, respectively (more readily described with reference to FIG. 6C). The third and fourth supplemental reinforcing structure members have a dual purpose of: (1) contributing to the reinforcement of the base plate 40 and (2) receiving and removably affixing wheel members to the base plate 40.

Figure 2:
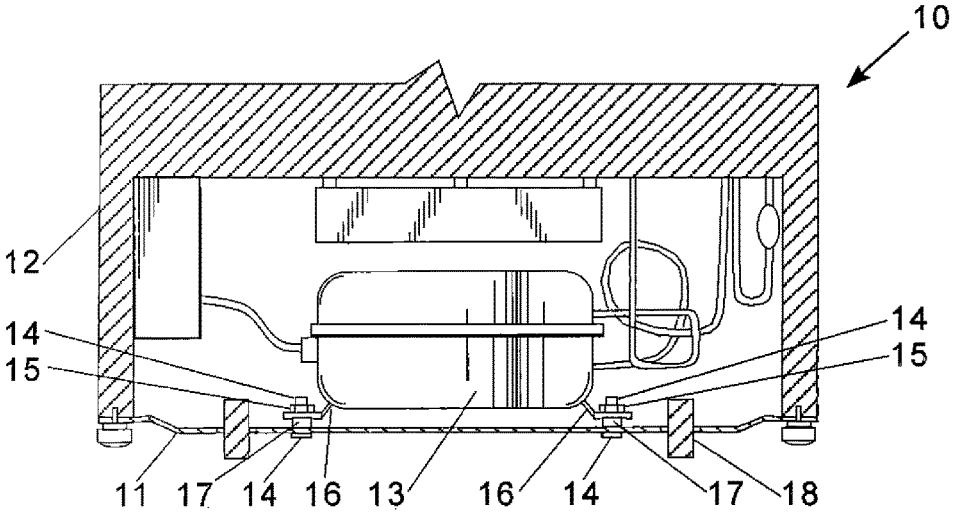
Fig. 2 (PRIOR ART)
FIG. 2 is a rear view, partly in cross-section, of the lower portion of the refrigerator of FIG. 1 showing the machine compartment of the refrigerator according to the conventional art.
Figure 6:
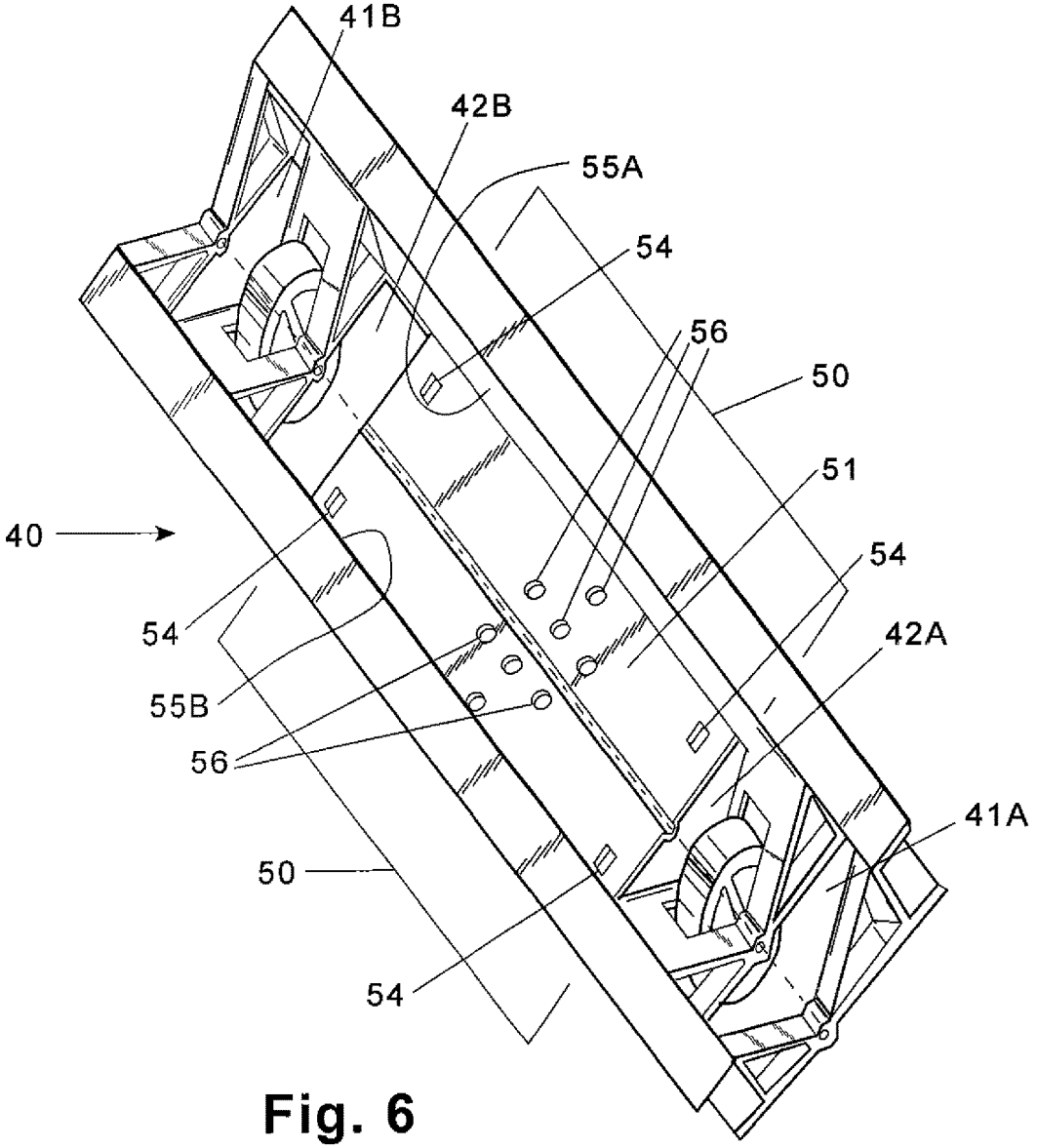
FIGS. 6, 6A, 6B and 6C are perspective views of one embodiment of a compressor mounting base plate of the present invention.
Figure 6A:
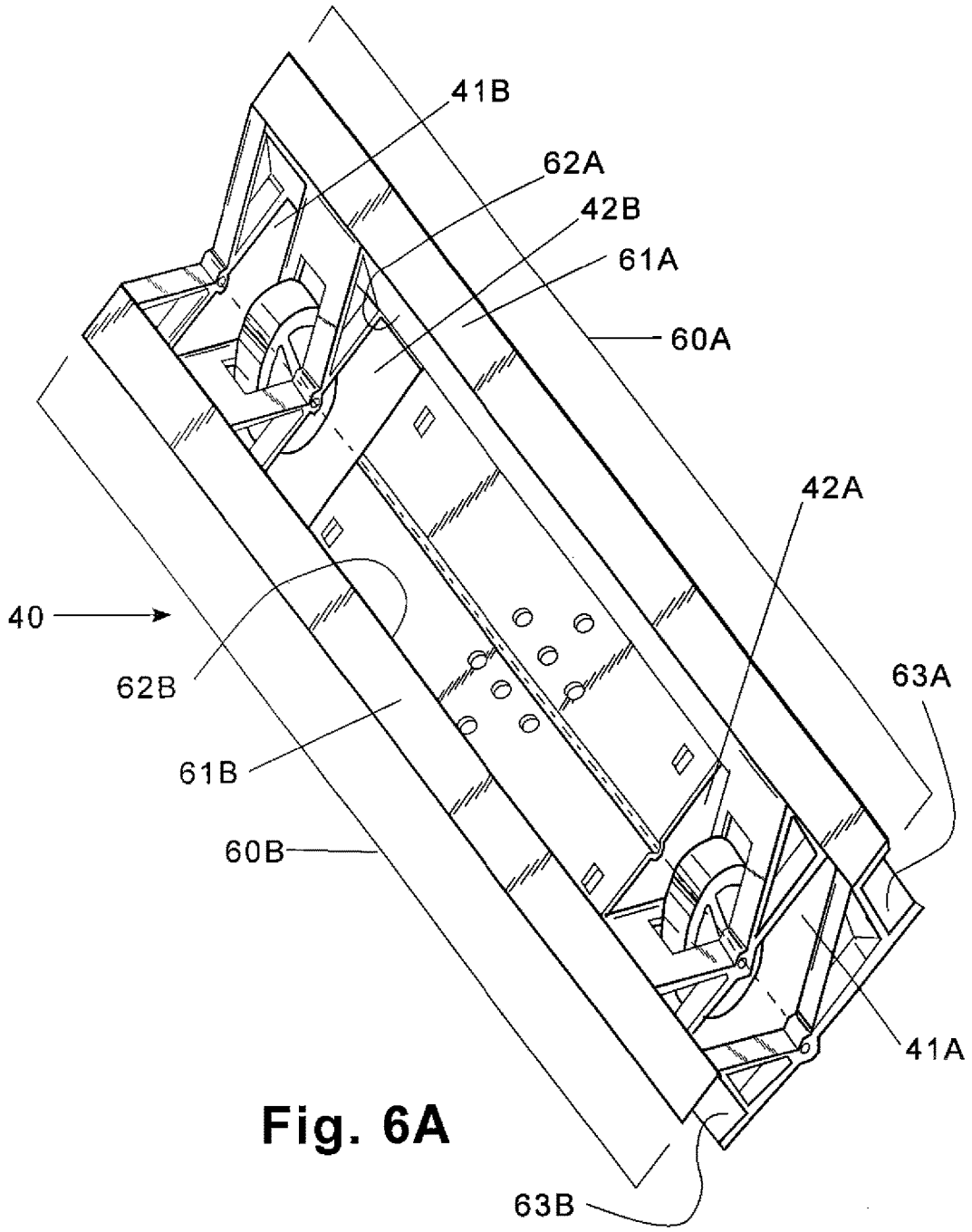
Figure 6B:
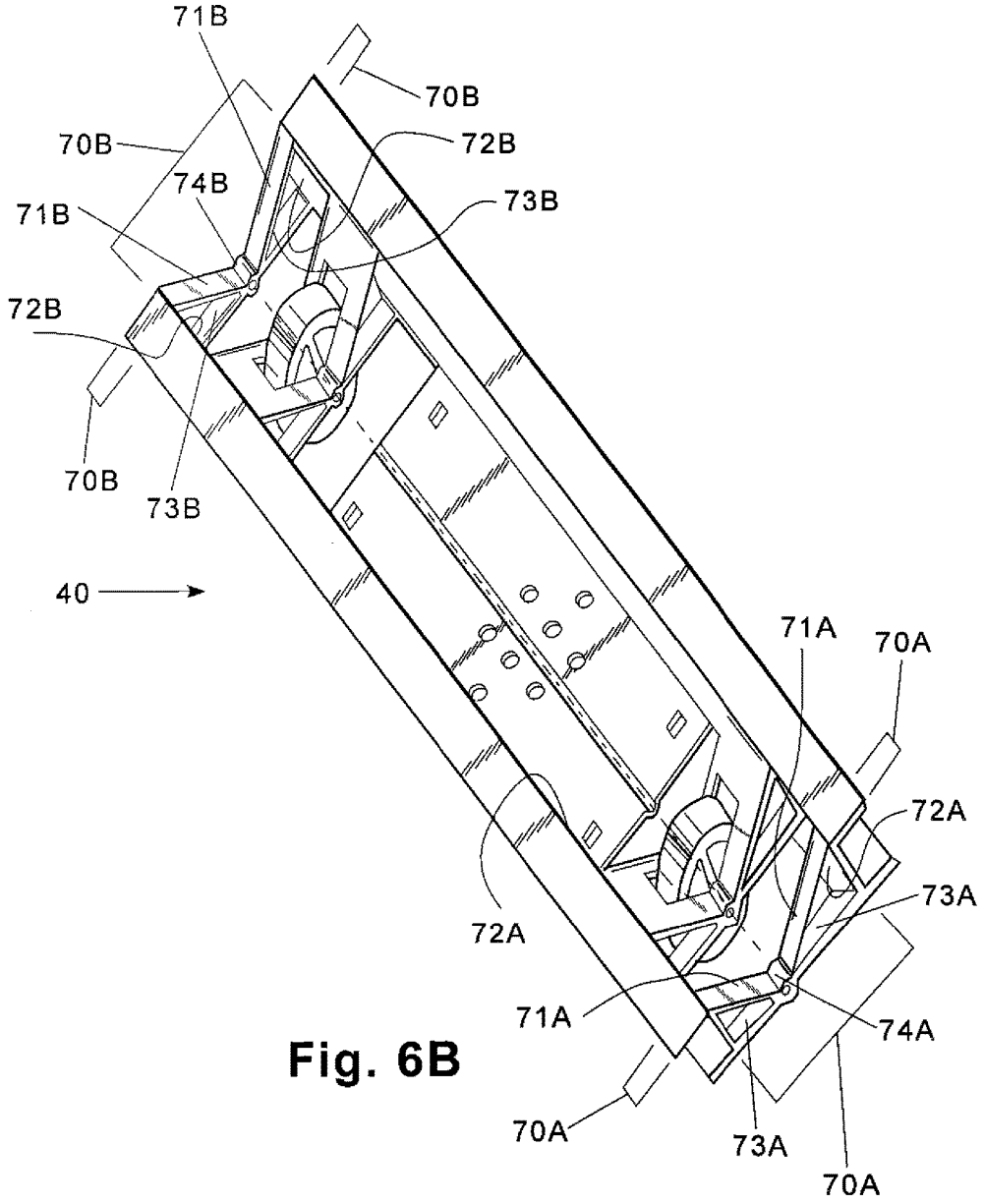

With reference to FIGS. 6, 6A-6C and 7-12, and particularly with reference to FIG. 6, the base plate segment, generally indicated by numeral 50, is adapted for receiving and removably affixing a compressor to the base plate 40. A compressor is not shown in FIGS. 6 and 6A-C; however, the compressor of the present invention may be similar to a conventional compressor 13 shown in FIG. 2. The base plate segment 50, as shown in FIGS. 6-8 and 7-12, contains a base plate member 51 which is generally flat or substantially planar, and has a top surface 52 and a bottom surface 53. The base plate member 51 is generally rectangular in shape and has two elongated sides opposite each other and two transverse sides opposite each other. The base plate member 51 is adapted for receiving the compressor, via one or more orifices 54, and is adapted for receiving a means for mounting/affixing a compressor to the top surface 52 of the base plate member 51. The means for affixing a compressor to the base plate segment may be generally disposed in the middle or central portion of the base plate member 51.

Figure 7:
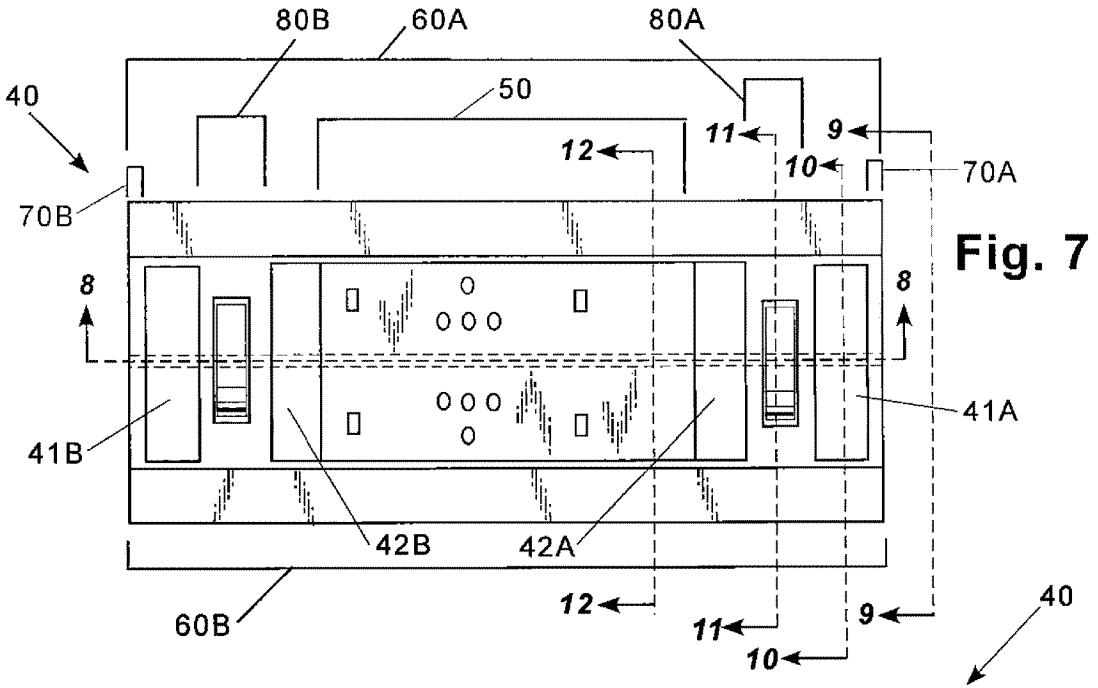
FIG. 7 is a top view of the compressor mounting base plate of FIG. 6.
Figure 8:
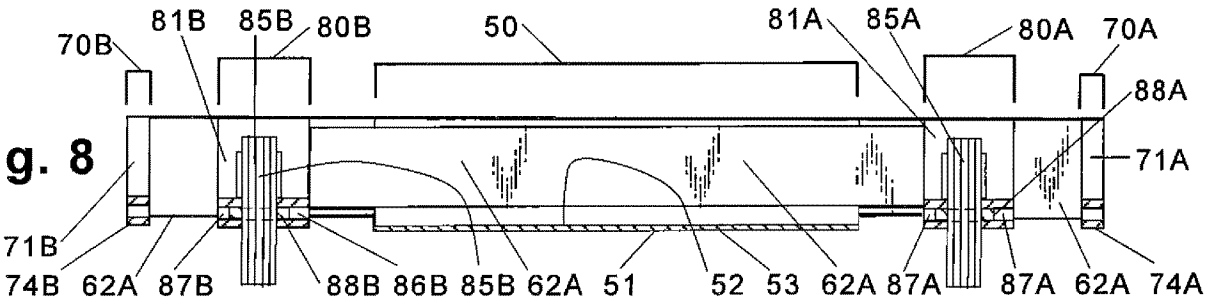
FIG. 8 is a cross-sectional view taken along line 8-8 of FIG. 7.

FIGS. 6-8 show the top surface 52 with the orifices 54 which are adapted for receiving and removably mounting or affixing a compressor to the top surface 52 of the base plate member 51 generally in the central portion of the base plate member 51.

Figure 3:
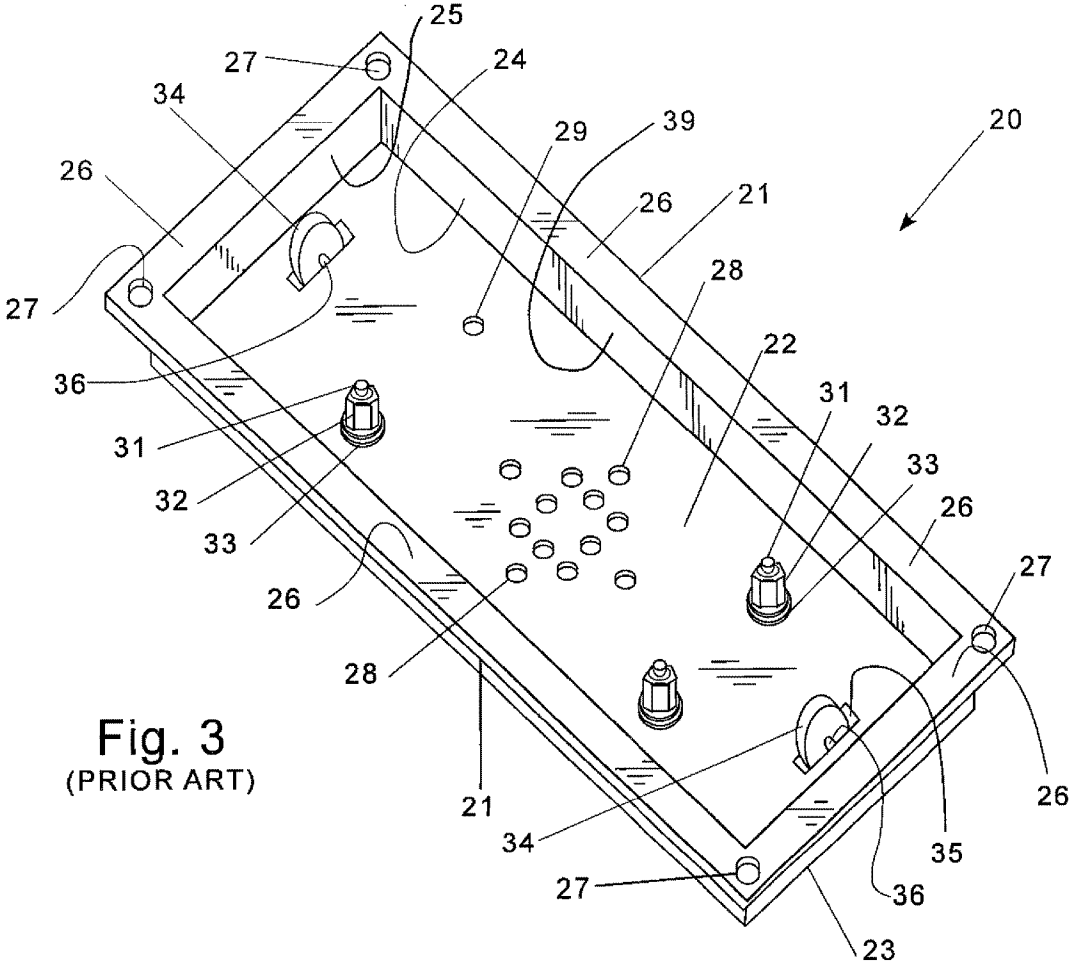
Fig. 3 (PRIOR ART)
FIG. 3 is a perspective view of a steel compressor mounting base plate of the prior art adapted to being installed in a refrigerator.

The compressor mounting means of the present invention includes for example one or more orifices 54 for receiving therethrough one or more threaded bolts. The threaded bolts are not shown in FIGS. 6 and 6A-6C; however, the threaded bolts of the present invention may be similar to conventional bolts 31 shown in FIG. 3.

The threaded bolts can be inserted through the orifices 54 from the bottom surface 53 of the base plate member 51 to the top surface 52 of the base plate and secured with one or more threaded nuts. The threaded nuts are not shown in FIGS. 6 and 6A-6C; however, the threaded nuts of the present invention may be similar to the conventional threaded nuts 32 shown in FIG. 3. The threaded nuts are used for engaging and locking the threaded bolts in place; and to secure the compressor on the base plate via support mounting brackets attached to the compressor. The support mounting brackets are not shown in FIGS. 6 and 6A-6C; however, the brackets of the present invention may be similar to conventional support mounting brackets 16 shown in FIGS. 1 and 2.

Figure 4:
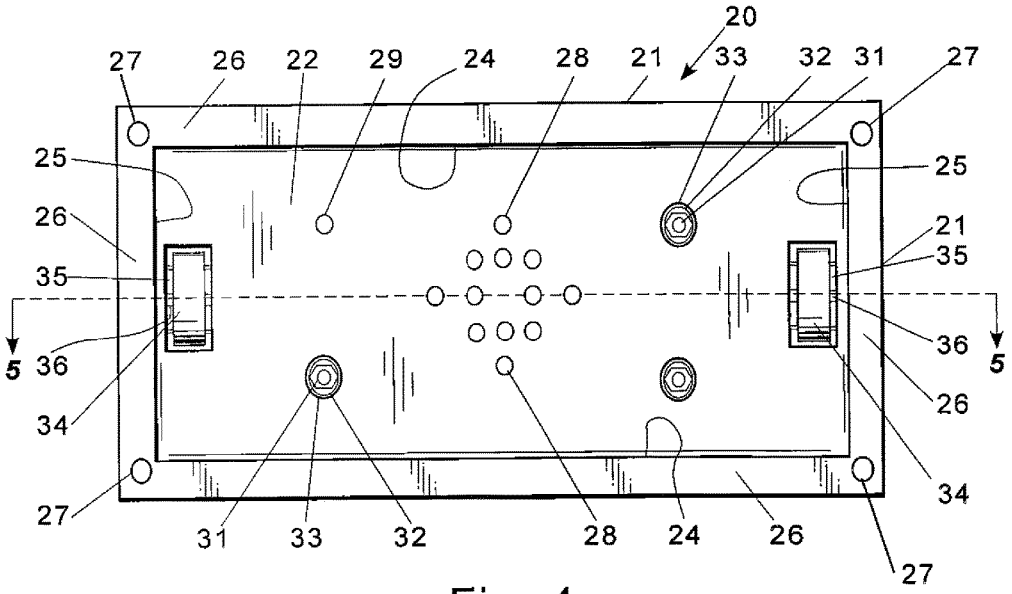
Fig. 4 (PRIOR ART)
FIG. 4 is a top view of a steel compressor mounting base plate of the prior art.
Figure 5:
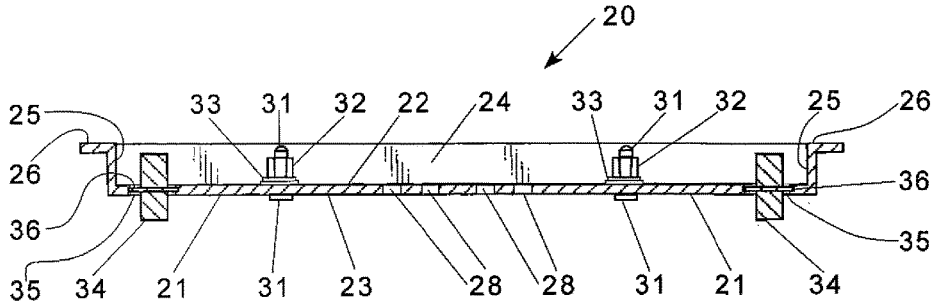
Fig. 5 (PRIOR ART)
FIG. 5 is a cross-sectional view of a steel compressor mounting plate of the prior art taken along line 5-5 of FIG. 5.

Inserted in-between the support mounting brackets attached to the compressor and the top surface 52 of the base plate member 51 is one or more vibration damper members. The vibration damper members are not shown in FIGS. 6 and 6A-6C; however, the vibration damper members of the present invention may be similar to the conventional dampers 17 shown in FIG. 2. Generally, the vibration damper members are made of rubber, and used to dampen the vibrations caused by the operation of the compressor. The compressor can be removably affixed to the top surface 52 of the base plate member 51 via threaded bolts inserted through orifices 54 in the base plate member 51 and threaded nuts for removably engaging the threaded bolts. The threaded bolts and threaded nuts members are not shown in FIGS. 6 and 6A-6C; however, the threaded bolts and threaded nuts members of the present invention may be similar to the conventional bolts 31 and nuts 32 shown in FIGS. 3-5.

The at least two, i.e., the first and second, elongated channel reinforcement members of the base plate 40 are generally indicated by numerals, 60A and 60B respectively; are integral with the base plate member 51 at the elongated longitudinal sides of the base plate member 51; and are adapted for reinforcing the base plate 40. The elongated reinforcement segments 60A and 60B advantageously provide the base plate 40 with increased strength and rigidity sufficient for the base plate 40 to withstand a deformation load from the heavy weight of a compressor. Typically, a compressor is made of steel and can be very heavy such as weighing up to 2 kg.

With reference to FIGS. 6, 6A-6C and 7-12 again, and particularly with reference to FIG. 6A, there is shown one embodiment of the elongated longitudinal reinforcement segments 60A and 60B integral with the base plate member 51. For example, the elongated reinforcement segments 60A and 60B, herein referred to as at least a first elongated reinforcing structure member 60A and at least a second elongated reinforcing structure member 60B, respectively, each comprising an elongated top ledge portion 61A and 61B, an elongated vertical sidewall portion 62A and 62B, and an elongated bottom ledge portion 63A and 63B, respectively, as shown in FIGS. 9-12. The first and second elongated reinforcing structure members 60A and 60B are disposed integrally with the base plate member 51—one elongated reinforcing structure member on each side of the longitudinal length of the base plate member 51. The first and second reinforcing structure members 60A and 60B are disposed parallel to each other on opposite sides of the longitudinal length of the base plate member 51.

In the embodiment shown in FIGS. 6, 6A-6C and 7-12, the first elongated reinforcing structure member 60A and the second elongated reinforcing structure member 60B, are shown as C-shaped channel members, when viewed in a side view as shown in FIGS. 9-12. The C-shaped channel members 60A and 60B comprise an elongated top ledge portion 61A and 61B, respectively, an elongated vertical sidewall portion 62A and 62B, respectively, and an elongated bottom ledge portion 63A and 63B, respectively, each portion 61A, 62A, and 63A being integral with each other, and each portion 61B, 62B, and 63B being integral with each other. The portions 61A-63A of the first elongated reinforcing structure member 60A at one longitudinal side of the base plate member 51 forms a forward facing C-shaped channel member and the portions 61B-63B of the second elongated reinforcing structure member 60B at the other longitudinal side of the base plate member 51 forms a backward facing C-shaped channel member in mirror image to the first elongated reinforcing structure member 60A.

The first elongated reinforcing structure member 60A and the second elongated reinforcing structure member 60B are integral with the base plate member 51. In FIGS. 6, 6A-6C and 7-12, the base plate 40 is shown as rectangular in shape with the reinforcing structure members 60A and 60B also functioning to provide vertical sidewall members 55A and 55B, respectively, on each side of the base plate member 51 to form a tray member (or pan member). The base plate 40 is shown as a rectangular-shaped member. However, the shape of the base plate 40 is not limited to a rectangle, but may include any shape desired that meets the requirements for a refrigerator unit including shapes such as an oval, a triangle, a pyramid, a square, and the like.

In addition, the elongated C-shaped channel members 60A and 60B comprise a shape that is conducive to and facilitates the fabrication of the compressor mounting base plate structure of the present invention using for example a pultrusion process. However, the shape of the first and second elongated reinforcing structure members 60A and 60B is not limited to a C-shaped channel member, but may include any shape desired that meets the requirements for reinforcing the base plate and for functioning in appliance equipment where the base plate is used such as a refrigerator unit. Each one of the elongated reinforcing structure members 60A and 60B, therefore, can be any shape that provides the required strength to the base plate 40. In another embodiment, for example, each of the elongated reinforcing structure members 60A and 60B, can include a hollow elongated tubular member in the shape of a triangle, an oval, rectangle, pyramid, trapezoid, square and the like, or a solid elongated bar or rib member in any of the aforementioned shapes and integral with the base plate. In general, the elongated reinforcing structure members 60A and 60B of the present embodiment shown in FIGS. 6, 6A-6C and 7-12 are C-shaped channel members in order to simplify the fabrication process via pultrusion and to minimize fabrication costs.

In the embodiment shown in FIGS. 6, 6A-6C and 7-12, the sidewalls 55A and 55B of the base plate member 51 are coterminous with the sidewall portions 62A and 62B, respectively, of the reinforcing structure members 60A and 60B, respectively; and the vertical sidewalls 55A and 62A or 55B and 62B of the base plate 40 generally have a plane that is disposed perpendicular to the horizontal plane of the base plate member 51 such that a tray member 40 is formed with the top surface 52 of the base plate member 51 forming the bottom portion of the tray member 40. The bottom portion of the tray member 40 (i.e., the top surface 52 of the base plate member 51) is adapted for receiving a compressor.

In addition, optionally the compressor mounting base plate structure 40 can include a means (not shown) for removably attaching the compressor mounting base plate to the machine compartment casing of the lower portion of a refrigerator unit. The removable attachment means can be for example one or more nuts and bolts removably affixed through an orifice (not shown) on the elongated top ledge portions 61A and 61B of the first and second reinforcing structures, respectively. The ledge portions 61A and 61B of the first and second reinforcing structure members are adapted to contain such means for attaching the compressor mounting base plate structure to the lower portion of the refrigerator unit.

In FIGS. 6, 6A-6C and 7-12, the base plate 40 is shown without a sidewall at a proximal end of the base plate member 51; and without a sidewall at a distal end of the base plate member 51; i.e., the two transverse ends of the base plate member 51 are open. However, optionally, the base plate 40 may include one or more additional or supplemental reinforcement means near the proximal and distal ends of the base plate 40. For example, in a preferred embodiment, shown in FIGS. 6, 6A-6C and 7-12 , and particularly with reference to FIG. 6B, the base plate 40 of this embodiment of the present invention includes an additional or a first supplemental reinforcement means comprising first and second supplemental reinforcing structure members generally indicated by numerals 70A and 70B, respectively; and each of the supplemental reinforcing structure members 70A and 70B is integrally connected to the base plate 40 via the first and second channel reinforcement members 60A and 60B, respectively; and particularly via conterminously with the second portions 62A and 62B, respectively. The first and second supplemental reinforcing structure members 70A and 70B are preferably disposed transverse to the horizontal plane of the base plate member 51 at the extreme transverse ends of the base plate member 51. That is, reinforcing sections 70A and 70B are located at both ends of the base plate 40, i.e., at the proximal end and at the distal end of the base plate 40 to provide further reinforcement to the base plate 40.

The optional first and second supplemental reinforcing structure members 70A and 70B of the present invention may comprise at least two planar inverted flat top truss-like structure members. One planar truss-like member 70A is disposed at the proximal end of the base plate 40 and transverse to the horizontal plane of the base plate member 51. Similarly, the other planar truss-like member 70B is disposed at the distal end of the base plate 40 and transverse to the horizontal plane of the base plate member 51. The first and second supplemental reinforcing structure members 70A and 70B are integral with the base plate 40 and advantageously provides the base plate 40 with further increased strength and rigidity, which allows the base plate 40 to withstand deformation load from the weight of a compressor when said compressor is heavy weight such as 6-9 kg.

Figure 9:
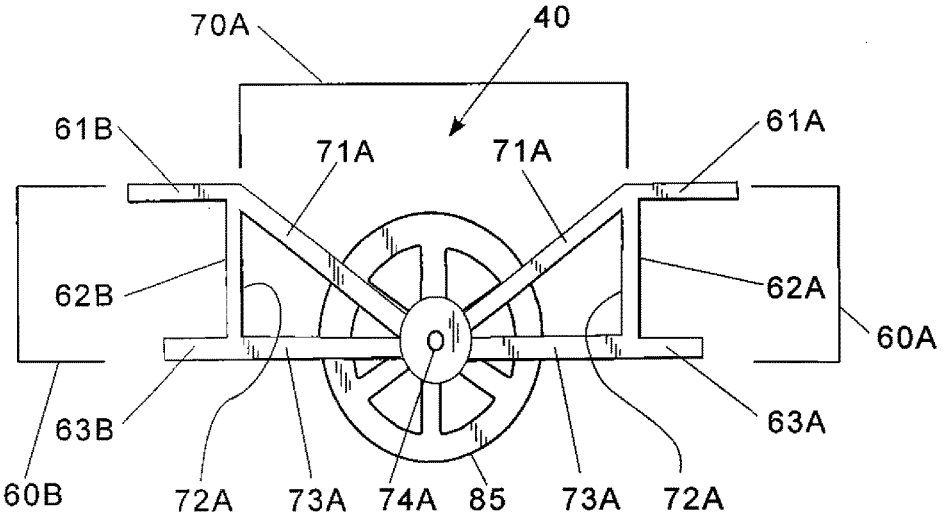
FIG. 9 is a side view taken along line 9-9 of FIG. 7.

The first and second supplemental reinforcing structure members 70A and 70B comprising the two planar inverted flat top truss-like structure members 70A and 70B, respectively, are referred to herein as a first and second supplemental reinforcing structures 70A and 70B, respectively. For example, when viewed from one end of the base plate 40, i.e., a side view as shown in FIG. 9, the first supplemental reinforcing structure 70A includes a truss-like structure member comprising a planar inverted flat top truss-like structure member when viewed from the side of the base plate 40 as shown in FIG. 9. The truss-like structure member 70A comprises at least two triangular units with straight portion members including straight portion members 71A, 72A and 73A, wherein the two triangular units meet at one end point (or vertex of an angle) such that each of the triangular units are connected to each other at a joint or a node area 74A. The side view of FIG. 9 shows the two triangular units comprising the truss-like member connected at node 74A and together forming a V-shaped supplemental reinforcing structure 70A. Similarly, the second supplemental reinforcing structure 70B is a truss-like structure member 70B and comprises at least two triangular units with straight portion members including straight portion members 71B, 72B and 73B, wherein the two triangular units meet at one end point (or vertex of an angle) such that each of the triangular units are connected to each other at a joint or a node area 74B. The shape and design of the truss-like members 70A and 70B advantageously provides the base plate 40 with added structural stability.

At each end of the base plate 40 along the width direction or transverse direction of the horizontal plane of the base plate 40 to further support a refrigerator are the first and second supplemental reinforcing structure members 70A and 70B. The central or middle portion of the base plate 40, via the base plate segment 50, provides torsion rigidity to the base plate 40 while the first and second supplemental reinforcing structure members 70A and 70B at the ends of the base plate 40 provide bending rigidity to the base plate 40 in the transverse direction of the base plate 40.

The base plate 40 of the present invention, in one embodiment shown in FIGS. 6, 6A-6C and 7-12, can optionally include a structural means, integral with the base plate 40, adapted for receiving and removably attaching a means for moving the refrigerator unit to its location of operation. For example, the moving means can include two or more wheel members. Once the wheel members are affixed to the base plate 40, the base plate 40 can be moved to and from the machine compartment case at the lower portion of a refrigerator unit during installation of the base plate 40 to the refrigerator unit. And, once the base plate 40 is affixed to the lower portion of the refrigerator unit with the wheel members; the refrigerator unit can be moved to and from a refrigerator's location of operation during installation of the refrigerator unit.

Figure 6C:
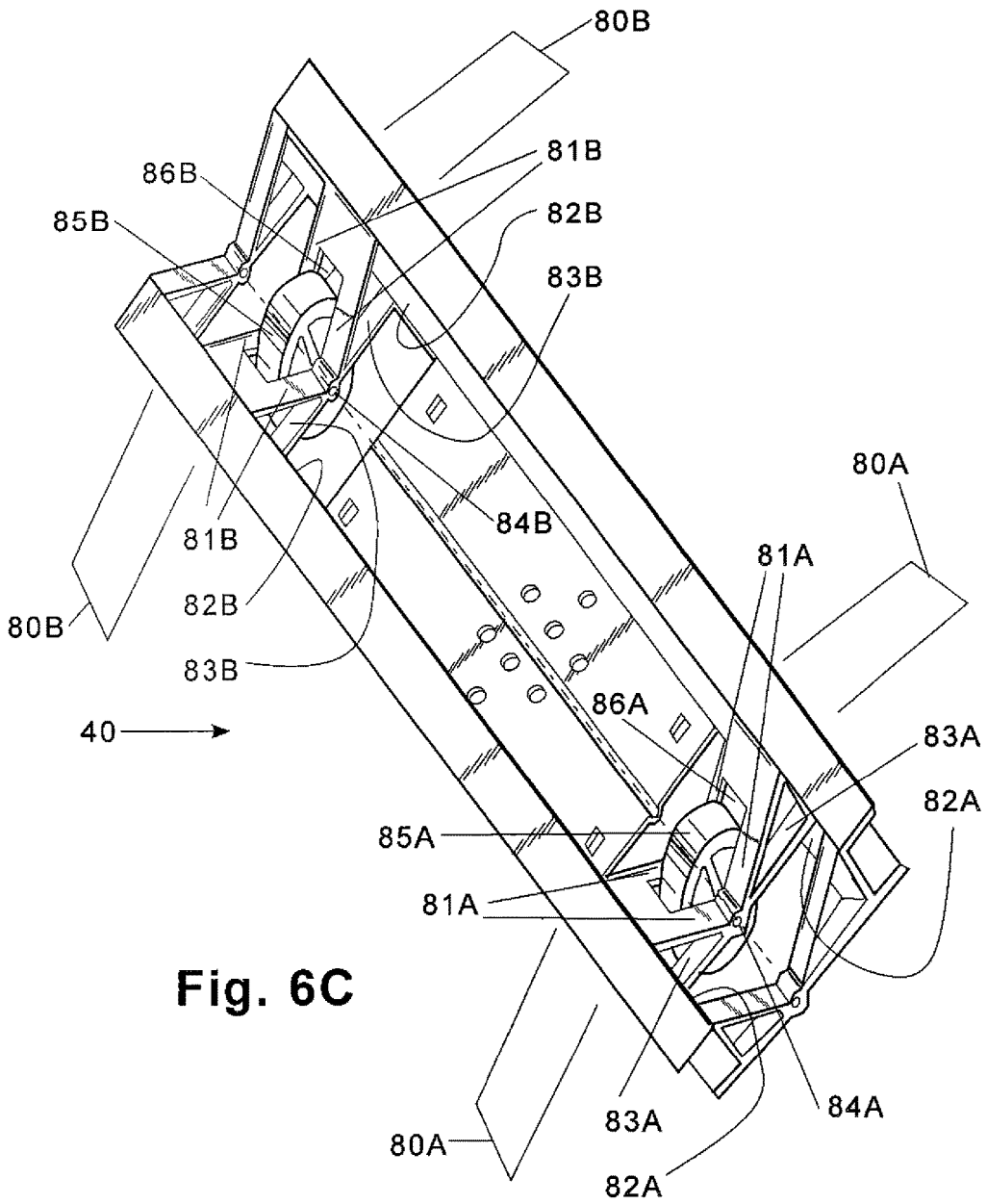

As shown in FIGS. 6, 6A-6C and 7-12 and particularly with reference to FIG. 6C, in another embodiment, the optional structural means adapted for receiving and removably attaching a means for moving the refrigerator unit can be for example an additional or second supplemental structural reinforcement means comprising at least a third and fourth supplemental reinforcing structure members which are generally indicated by numerals 80A and 80B, respectively; and which are integrally connected to the base plate 40. The second supplemental structural reinforcement means is adapted for (i) contributing to the overall reinforcement of the compressor mounting base plate structure, and (ii) receiving and removably affixing a means for moving the compressor mounting base plate structure. For example, the third and fourth supplemental reinforcing structure members preferably have the dual purpose of: (i) contributing to the reinforcement of the base plate 40 and (ii) receiving and removably affixing wheel members to the base plate 40.

The third and fourth supplemental reinforcing structure members 80A and 80B, when used, are integrally connected to the first and second channel reinforcement members 60A and 60B, respectively; and particularly via conterminously with the second portions 62A and 62B, respectively. The third and fourth supplemental reinforcing structure members 80A and 80B are disposed transverse to the horizontal plane of the base plate member 51 near the transverse ends of the base plate member 51. That is, reinforcing sections 80A and 80B are located at near both ends of the base plate 40, i.e., at near the proximal end and at near the distal end of the base plate 40, respectively, to provide even further reinforcement to the base plate 40.

The optional third and fourth supplemental reinforcing structure members 80A and 80B of the present invention may comprise at least two planar inverted flat top truss-like structure members similar to the inverted flat top truss-like structure members 70A and 70B described above. For example, one planar truss-like member 80A, as shown in FIGS. 6, 6A-6C and 7-12, is disposed at near the proximal end of the base plate 40 and the other planar truss-like member 80B is disposed at near the distal end of the base plate 40. The third and fourth supplemental reinforcing structure members 80A and 80B are integral with the base plate 40 and advantageously provides the base plate 40 with further increased strength and rigidity, which allows the base plate 40 to withstand deformation load from the weight of a compressor.

Figure 10:
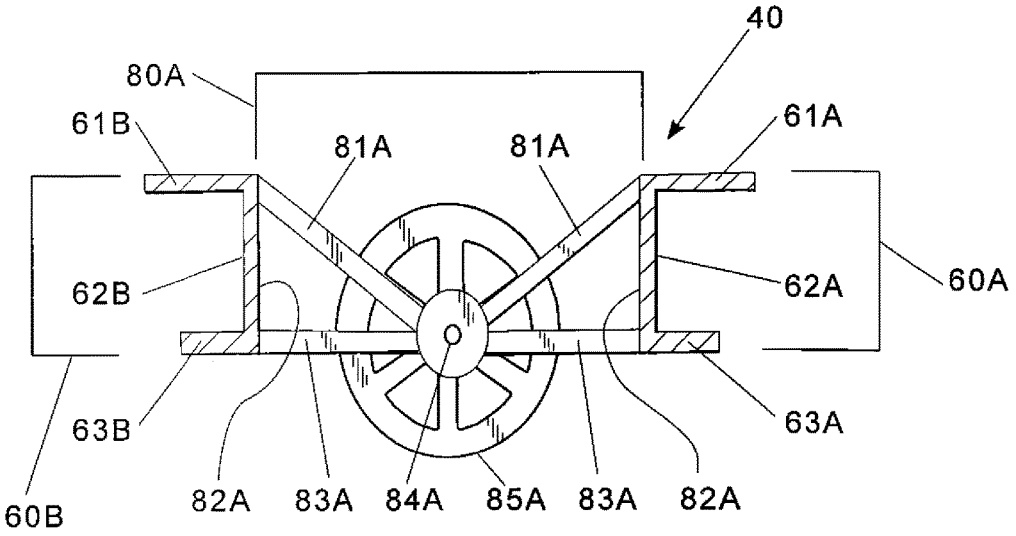
FIG. 10 is a cross-sectional view taken along line 10-10 of FIG. 7.
Figure 11:
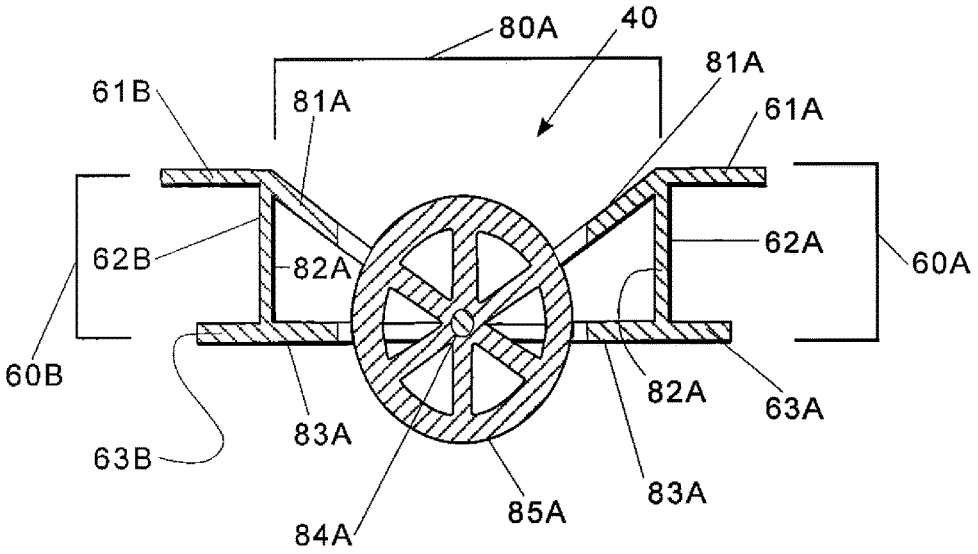
FIG. 11 is a cross-sectional view taken along line 11-11 of FIG. 7.
Figure 12:
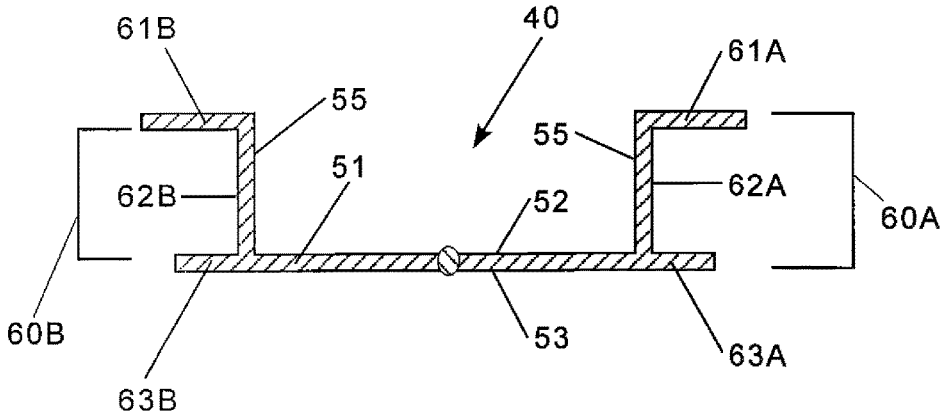
FIG. 12 is a cross-sectional view taken along line 12-12 of FIG. 7.

The third and fourth supplemental reinforcing structure members 80A and 80B comprising the two planar inverted flat top truss-like structure members 80A and 80B, respectively, are referred to herein as a third and fourth supplemental reinforcing structures members 80A and 80B, respectively. For example, when viewed from one end of the base plate 40, i.e., a side view partly in cross-section, as shown in FIG. 10 and a cross-sectional side view as shown in FIG. 11, the third supplemental reinforcing structure member 80A includes a truss-like structure member comprising a planar inverted flat top truss-like structure member when viewed from the side of the base plate 40 as shown in FIGS. 10 and 11. The truss-like structure member comprises at least two triangular units with straight portion members including straight portion members 81A, 82A and 83A, wherein the two triangular units meet at one end point (or vertex of an angle) such that each of the triangular units are connected to each other at a joint or a node area 84A. The side view of FIGS. 10 and 11 shows the two triangular units comprising the truss-like member connected at node 84A and together forming a V-shaped third supplemental reinforcing structure 80A. Similarly, the fourth supplemental reinforcing structure 80B is a truss-like structure member 80B and comprises at least two triangular units with straight portion members including straight portion members 81B, 82B and 83B, wherein the two triangular units meet at one end point (or vertex of an angle) such that each of the triangular units are connected to each other at a joint or a node area 84B. The shape and design of the truss-like members 80A and 80B advantageously provides the base plate 40 with added structural stability.

The means for moving the refrigerator unit removably attached to the base plate 40 structure includes as one example, at least two wheel members 85A and 85B. One of the wheel members 85A can be removably attached to the third supplemental reinforcing structure member 80A and the other of the wheel member 85B can be removably attached to the fourth supplemental reinforcing structure member 80B. Each of the supplemental reinforcing structure members 80A and 80B include a spacing or slot 86A and 86B, respectively, for receiving a wheel member 85A and 85B, respectively. In addition each of the supplemental reinforcing structure members 80A and 80B include a tubular member 87A and 87B, respectively, for receiving a rod axle member 88A and 88B, respectively, for removably attaching the wheel members 85A and 85B, respectively, to the supplemental reinforcing structure members 80A and 80B, respectively. The nodes 84A and 84B are the points where the tubular members 86A and 86B, respectively, are located; and where the axle members 87A and 87B, respectively, for the wheel members 85A and 85B, respectively, are disposed. The wheels 85A and 85B attached to the base plate 40 provide a means for easily moving the refrigerator with base plate into position for use. Preferably, the third and fourth truss-like members 80A and 80B are of a sufficient width to accommodate spacings or slots 86A and 86B, respectively, such that the slots 86A and 86B can receive wheel members 85A and 85B, respectively.

Therefore, the supplemental reinforcing structure members 80A and 80B serve at least two purposes including (i) a means for accommodating and removably attaching a wheel member 85A and 85B for the base plate 40; and (ii) a means for further increasing the strength and rigidity of the base plate 40 to withstand a deformation load from the weight of a compressor.

In a preferred embodiment, the third supplemental reinforcing structure member 80A is disposed near the proximal end of the base plate 40 and in-between the base plate member 51 and the first supplemental reinforcing structure member 70A; and the fourth supplemental reinforcing structure members 80B is disposed near the distal end of the base plate 40 and in-between the base plate member 51 and the second supplemental reinforcing structure member 70B, thus preferably placing the wheels near the proximal and distal ends of the base plate 40.

In addition, in one embodiment shown in FIGS. 6, 6A-6C and 7-12, and particularly in FIG. 7, an optional spacing or slot 41A is disposed in-between the supplemental reinforcing structure member 70A and the supplemental reinforcing structure member 80A; and an optional spacing or slot 41B is disposed in-between the supplemental reinforcing structure member 70B and the supplemental reinforcing structure member 80B. Furthermore, the embodiment shown in FIGS. 6, 6A-6C and 7-12, and particularly in FIG. 7, also contains an optional spacing or slot 42A disposed in-between the supplemental reinforcing structure member 80A and one transverse end of the base plate member 51; and also contains an optional spacing or slot 42B disposed in-between the supplemental reinforcing structure member 80B and the other transverse end of base plate member 51.

In another embodiment, the base plate member 51, shown in FIGS. 6, 6A-6C and 7-12, may optionally contain one or more venting orifices 56 for allowing air to pass through the orifices 56 and to circulate throughout the machine compartment casing of a refrigerator unit; and to allow drainage of any standing water on the surface 52 of the base plate member 51. For example, as shown in FIGS. 6 and 7, a plurality of orifices 56 is disposed generally in the central or middle portion of the base plate member 51.

Optionally, in another embodiment, the base plate 40 of the present invention can include a means for receiving and retaining liquid condensation (not shown) that may occur in the machine compartment casing of a refrigerator unit during operation of the refrigerator unit. For example, the means for receiving and retaining liquid condensation may comprise a dip tray member (not shown) either integral with the base plate 40; or removably attached to the top surface 52 of the base plate member 51 of the base plate 40. As aforementioned, the dip tray member is adapted for collecting a liquid, i.e., the drip tray is used to capture and collect water formed through condensation or other liquid in the machine compartment of the refrigerator unit.

Figure 13:
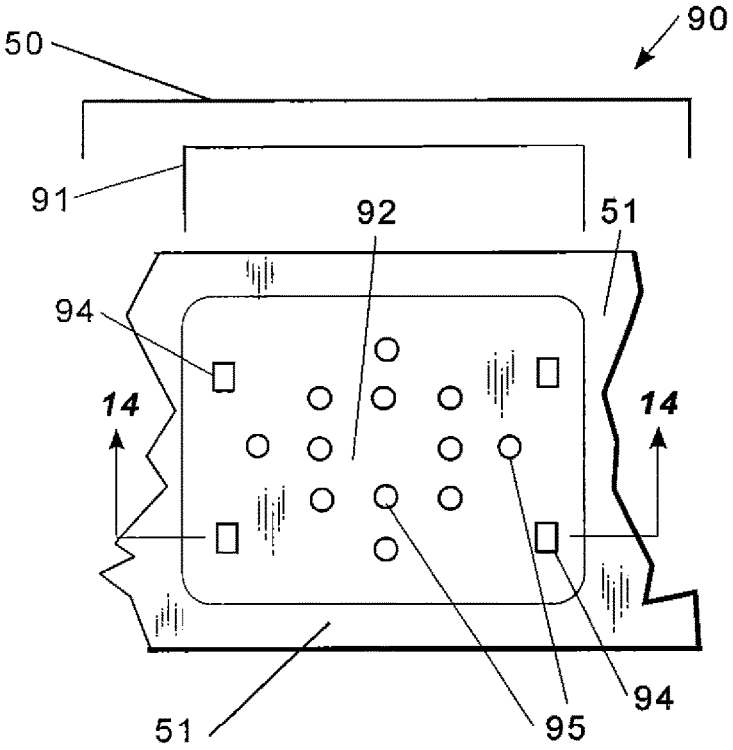
FIG. 13 is a top view of another embodiment of the base plate segment of a compressor mounting base plate structure of the present invention.
Figure 14:
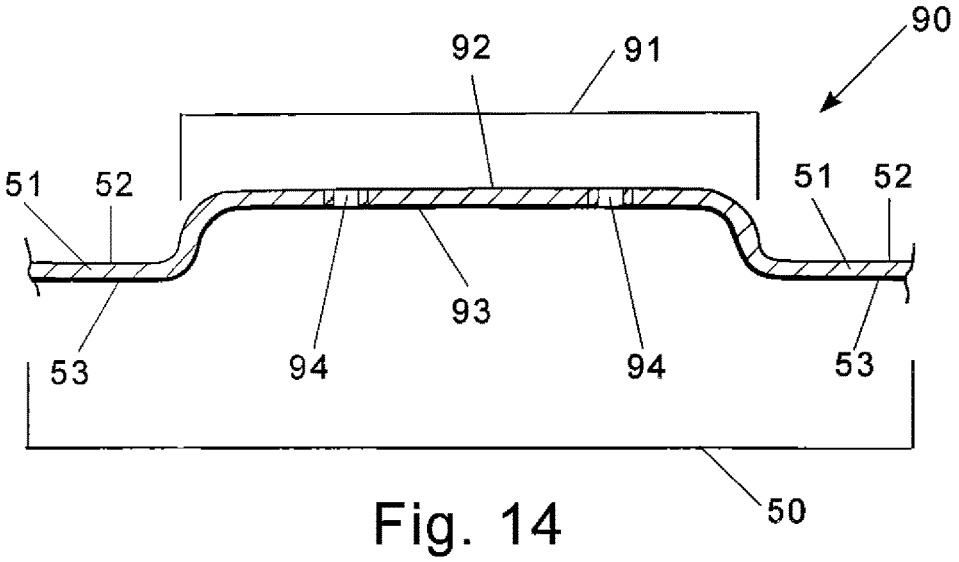
FIG. 14 is a cross-sectional view taken along line 14-14 of FIG. 13.

With reference to FIGS. 13 and 14, there is shown another embodiment of a compressor mounting base plate of the present invention made using a pultrusion process. The base plate of the present invention, shown in FIGS. 13 and 14, is generally indicated by reference numeral 90. In one embodiment, the base plate 90 of the present invention can include, as an optional structural element, at least one load bearing/load distributing structure member integral with the base plate 90 such that the load bearing/load distributing structure member is adapted for providing additional strength, reinforcement and integrity to the base plate 90. For example, as shown in FIGS. 13 and 14, the load bearing/load distributing structure can be a raised surface area 91, having a top surface 92 and a bottom surface 93. Preferably, the raised surface area 91 is disposed in at least a portion of the base plate member 51 of the base plate 90; and generally in the central or middle portion of the base plate member 51. The raised area 91 is adapted for receiving the compressor via orifices 94.

The raised area 91 of the base plate member 51, shown in FIGS. 13 and 14, may optionally contain one or more venting orifices 95 for allowing air to pass through the orifices 95 and to circulate throughout the machine compartment casing of a refrigerator unit. For example, as shown in FIGS. 13 and 14, a plurality of orifices 95 are disposed generally in the central or middle portion of the base plate member 51 leaving a top surface area 52 around the raised portion 91.

Generally, in one embodiment of the present invention, the compressor mounting base plate structure can be a one-piece body member made of a non-metal, corrosion resistant synthetic resin or composite material. For example, the composite material can be a synthetic thermosetting resin material such as a polyurethane polymer resin, an epoxy resin, or a polyester resin. In a preferred embodiment, the one-piece body member can be made from curable composition including a combination of (a) a synthetic thermosetting resin matrix binder material and (b) a reinforcement material. Generally, the curable composition is prepared by admixing a thermosetting resin material a curing agent to form the binder material; and then a reinforcing material is added to the binder material.

A wide variety of reinforcement materials can be suitable for use in producing the compressor mounting base plate structure. In one preferred embodiment, a fiber reinforcement material is used. For example, fiber reinforcing materials may include woven fibers, non-woven (random) fibers, or a combination thereof.

Examples of suitable reinforcing fibers useful for the curable composition or formulation may be selected from fibers, such as for example but not limited to, mineral or ceramic fibers such as Wollastonite, aluminum, glass fibers, carbon fibers and the like; synthetic fibers of nylon, polyester, aramid, polyether ketones, polyether sulfones, polyamides, silicon carbon, and the like; natural fibers such as cellulose, cotton, hemp, flaxes, jute and kanaf fibers; metal fibers; and mixtures thereof. Biocomponent fibers such as a non-glass material spun bonded non-woven having a polyester core and polyamide skin, may also be used.

Glass fiber, either woven or non-woven, such as fiber made from E-glass and S-glass, is the preferred reinforcement material used in the present invention due to its low cost and physical properties. Typically, the reinforcing fibers have an average length of at least 1.00 mm. The reinforcing fibers also typically have a diameter of between about 5 microns and about 20 microns. The fibers may be used in the form of chopped strands or individual chopped filaments.

The matrix binder useful in the present invention for the composition or formulation for constructing the composite body defining the compressor mounting base plate structure may be a thermoset polymer or a thermoplastic polymer. Typically the matrix binder is selected from a group of materials consisting of polyolefins, polyesters, polyamides, polypropylene, copolymers of polyethylene and polypropylene, polyethylene, nylon 6, nylon 66, high heat nylons, copolymers of nylon 6, nylon 66 and high heat nylons, polycarbonate/acrylonitrile butadiene styrene blend, styrene acrylonitrile, polyphenylene sulfide, polyvinyl chloride, polybutylene terephthalate, polyethylene terephthalate, polyurethane, epoxy, vinyl ester, phenolic compound, dicyclopentadiene and mixtures thereof. The matrix binder may be used in liquid form, powder form, pellet form, fiber form and/or bi-component fiber form. The physical form of these matrix materials (i.e., their viscosities, particle sizes, etc.) is well-known in the art, variable to be compatible with the particular pultrusion process chosen to fabricate the composite, and typical of "standard" matrix materials known in the industry.

Generally, the composite body comprises between about 20 weight percent (wt %) and about 50 wt % reinforcing fibers and between about 50 wt % and about 80 wt % matrix binder. In one embodiment, the composite body has a density of between about 1.0 g/cm$^3$ and about 2.0 g/cm$^3$.

In a preferred embodiment, a polyurethane-isocyanate composition can be used in the present invention as the synthetic material binder matrix with various reinforcement materials to produce the compressor mounting base plate structure.

There may be several methods used for forming the curable formulation or composition for preparing the base plate 40. For example, in one embodiment, the curable composition is prepared by mixing a thermosetting resin matrix material and the fiber reinforcement material described above. In addition, the preparation of the binder resin matrix and reinforcement material composition or formulation of the present invention, and/or any of the steps thereof, may be a batch or a continuous process. The mixing equipment used in the process may be any vessel and ancillary equipment well known to those skilled in the art.

In general, the composition for fabricating the compressor mounting base plate structure according to an exemplary embodiment of the present invention can be formed by mixing the synthetic resin matrix material and the reinforcement material such as reinforcing fibers arranged to be processed according to a pultrusion process described herein below. That is, the compressor mounting base plate structure may be fabricated by combining the reinforcing fibers with the resin matrix material.

In a preferred embodiment, the compressor mounting base plate composite article of the present invention which is useful in refrigerators is preferably made of a synthetic resin through the use of, for example, a pultrusion process. In the present invention, a most suitable preferred embodiment is to form the compressor mounting base plate structure by using a pultrusion process in order to maximize the strength of the compressor mounting base plate structure and reduce the fabrication costs of the compressor mounting base plate structure.

For example, as is well known in the art, pultrusion is the process of "pulling" raw composite material, such as fiberglass and resin, through a shaped heated die creating a continuous composite profile. The profile that exits the die is a cured pultruded Fiber Reinforced Polymer (FRP) composite. In a preferred embodiment, a pultrusion process can be used in the present invention to fabricate the compressor mounting base plate in a pultruded one-piece body made of a non-metal, corrosion resistant composite material. The pultrusion process uses glass fiber and a thermosetting resin to make a structurally strong composite. A pultrusion process useful in the present invention is described for example in U.S. Patent No 7,056,796; incorporated herein by reference.

A typical pultrusion process includes, for example, the following general steps:

Step (1): A reinforcement material in the form of raw fiber (e.g., glass, carbon, aramid, or mixtures thereof) is pulled off of doffs or rolls from a creel racking system.

Step (2): The raw fiber being pulled off the racks in Step (1) are guided through a resin bath or resin impregnation system. The resin bath includes the raw resin matrix composition comprising a thermosetting resin, optionally combined with fillers, catalysts, pigments and other additives. The resin can be polyester resin, vinyl ester, epoxy or urethane as described above. As the fibers are passed through the resin bath, the fibers become fully impregnated (wetted-out) with the resin matrix such that all the fiber filaments are thoroughly saturated with the resin mixture.

Step (3): Using guiding systems, the impregnated fibers of Step (2) are led through a heated die. The entrance of the heated die is often cooled to avoid curing the resin while excess resin is squeezed off.

Step (4): As the fiber and resin is pulled through the heated die in Step (3), the resin cures and exits as a fully formed composite. The shape of the pultruded composite part will match the shape of the die. The profile that exits the die is a cured pultruded profile which can be referred to as a Fiber Reinforced Polymer (FRP) composite. The pulling action in this process is accomplished by a set of "pullers" or "grippers" which are pulling the material at a continuous and consistent rate.

Step (5): At the end of the pultrusion process, a cut-off saw is used to cut the pultruded profiles from Step (4) to a specific desired length and then the cut pultruded profiles are stacked for delivery.

In one embodiment of the compressor mounting base plate structure as shown in FIG. 6, the above pultrusion process is used for example with a polyurethane resin and a glass fiber reinforcement to form a composite. The thickness of the composite compressor mounting base plate structure can be, for example, from about 0.5 mm to about 20 mm in one embodiment; from about 0.5 mm to about 15 mm in another embodiment, and from about 0.8 mm to about 5 mm in still another embodiment.

The compressor mounting base plate structure made of a composite material which is a thermoset material (i.e., a cross-linked product made from the formulation) of the present invention shows several improved properties over conventional steel base plates.

The resulting compressor mounting base plate structure fabricated by the present invention process can have a combination of properties that makes the base plate superior to conventional iron, steel, or aluminum compressor mounting base plate structures such as for example in a specific strength. For example, the static stiffness of a compressor mounting base plate structure made from steel is typically about 634 N/mm, whereas the static stiffness of the compressor mounting base plate structure according to an exemplary embodiment of the present invention can be about 679 N/mm. In addition, dynamic stiffness of an exemplary embodiment of the present invention can be for example 30 Hz as its first frequency where as for a steel base plate typically the dynamic stiffness is 21 Hz under modal analysis. Accordingly, the base plate of the present invention can have the same strength as that of the existing conventional steel base plate but the weight of the base plate of the present invention can be minimized In a preferred embodiment, the resin matrix material used in the present invention may be epoxy or polyester in terms of costs and effectiveness. In addition, the reinforcing fibers used in the present invention may be glass fibers which are low-priced and have a suitable strength. In other embodiment, the reinforcing fibers can be other nonmetal fibers such as boron, carbon, graphite, Kevlar, and the like as described above.

The polyurethane resin and glass fiber composite material specification for the pultruded compressor mounting base plate structure includes for example, a Young's Modulus of from about 1.0 GPa to about 100 GPa in one embodiment, and from about 5 GPa to about 40 GPa in another embodiment; a Poisson's ratio of from about 0.01 to about 0.4 in one embodiment, and from about 0.1 to about 0.35 in another embodiment; and a density of from about 500 $Kg/m^3$ to about 4,000 $Kg/m^3$ in one embodiment, and from about 800 $Kg/m^3$ to about 2,500 $Kg/m^3$.

The composite compressor mounting base plate structure of the present invention also exhibits other advantageous properties. For example, the tensile strength of the base plate can be from about 70 MPa to about 900 MPa in one embodiment; and from about 500 MPa to about 770 MPa in another preferred embodiment, as measured by the test method DIN EN ISO 527 (2012). The tensile strength of the base plate is preferably measured by taking a sample length of 600 mm, and testing the sample by a 20T standard hydraulic materials testing machine, the moving speed of the gripping fixture is 5 mm/min during the test.

The flexural modulus of the base plate can be from about 3.5 GPa to about 40 GPa in one embodiment; and from about 10 GPa to about 34 GPa in another preferred embodiment, as measured by the test method DIN EN ISO 178 (2011).

Also, the % elongation of the base plate can be from about 1% to about 7% in one embodiment; and from about 1% to about 2.5% in another preferred embodiment, as measured by the test method DIN EN ISO 527 (2012).

Base plates made of polyurethane composite material exhibits better/excellent damping properties over base plates made of steel, providing vibration absorption characteristics transmitted by a compressor. For example, the damping increase of a composite material of the present invention base plate over steel can be generally from about 50% to about 900% in one embodiment, and from about 300% to about 700% in another embodiment.

Other properties of the composite product which is a thermoset product (i.e., a cross-linked product made from the above-described formulation) of the present invention can be improved over conventional products such as for example the DMA measurement of the base plate, the radial pressure resistance of the base plate, and the bending measurement of the base plate. The DMA $T_g$ and $T_t$ of the base plate are preferably measured by ASTM D7028-07e1. The radial pressure resistance of the base plate is preferably measured by the radial pressure resistance test at GB/T 7314-2005. The bending of the base plate is preferably measured by a bending test by rolling a sample on the surface of a cylinder with a diameter of 300 mm for 720°.

In another embodiment, the pultruded compressor mounting base plate structure of the present invention, which can be a composite product of polyurethane resin and glass fiber composite material, may have a glass transition temperature (Tg) generally from 80° C. to about 150° C. in one embodiment; and from about 100° C. to about 120° C. in another embodiment. The Tg may be measured using a differential scanning calorimeter by scanning at 10° C./minute. The Tg is determined by the inflection point of the $2^{nd}$ order transition.

The composite system of the present invention is used to prepare a compressor mounting plate for an appliance device, particularly for example a refrigerator. For example, the compressor mounting base plate structure of the present invention is advantageously used in a refrigerator unit wherein the base plate structure is installed in the machine compartment of the refrigerator. To achieve the advantages in accordance with the purpose of the present invention, as embodied and broadly described herein, in general, there is provided a refrigerator including: (a) a refrigerator main body having a cooling chamber for storing foods; (b) a machine compartment; (c) a compressor mounting base plate structure installed in the machine compartment located at a lower portion of the refrigerator main body; said compressor mounting base plate structure adapted for receiving and supporting a compressor; and (d) a compressor mounted on the compressor mounting base plate structure. The compressor mounting base plate structure engages the machine compartment forming the bottom structure of the machine compartment casing and together with the lower portion of the refrigerator main body, the top surface of the base plate defines the machine compartment of the refrigerator.

Generally, a refrigerator is comprised of: a main body having a cooling chamber such as a freezing chamber and a refrigerating chamber therein; and a machine compartment positioned at a lower portion of a rear side of the main body and having various components forming a refrigeration cycle such as a compressor for compressing a refrigerant. Other parts of the refrigerator may include, for example, a control box for controlling the refrigeration cycle installed inside of the machine compartment and a separate water tray installed inside of the machine compartment for storing water generated from the refrigeration cycle by a defrosting operation.

The compressor mounting base plate structure of the present invention is mounted on a lower bottom portion of the machine compartment; and a compressor is mounted on the compressor mounting base plate structure. The compressor mounting base plate structure is affixed to the lower portion of the main body by any attachment which can be removable such as mounting brackets and one or more nuts and bolts.

In the present invention, the compressor can be installed on the compressor mounting base plate structure by a mounting bracket system including a support bracket, a vibration preventing rubber member removably attached to the mounting bracket for preventing vibration generated from the compressor from being transferred to the main refrigerator body; and nuts and bolts to firmly affix the compressor to the base plate structure.

When the refrigerator containing the compressor mounting base plate structure of the present invention is constructed and operated as aforementioned the improvements described above can be achieved.

EXAMPLES

The following examples and comparative examples further illustrate the present invention in detail but are not to be construed to limit the scope thereof.

The following materials are used in the Example:

VORAFORCE TP 203 is a diglycidylether of bisphenol-A type of epoxy resin and commercially available from The Dow Chemical Company.

VORAFORCE TP 253 is an epoxy hardener composition including a combination of (i) tetrahydro-4-methylphthalic anhydride (80%-90%), (ii) 1,2,3,6-tetrahydrophthalic anhydride (10%-20%), and (iii) benzyltriethylammonium chloride (<2%); and commercially available from The Dow Chemical Company.

VORAFORCE TC 3000 is an accelerator, 1-methylimidazole, and commercially available from The Dow Chemical Company.

Example 1

An example of a fiber-reinforced composite of an elongated non-metal, corrosion resistant compressor mounting base plate structure for a refrigerator unit in accordance with the present invention can be prepared as follows:

A. Curable Composition or Formulation

A curable epoxy resin composition is prepared by mixing 100 parts by weight (pbw) of VORAFORCE TP 203; 85 pbw of VORAFORCE TP 253; and 0.5-1.5 pbw of VORAFORCE TC 3000.

B. Pultrusion Procedure

The above epoxy resin composition is then used in a pultrusion process to fabricate a fiber-reinforced composite of an elongated non-metal, non-corrosive compressor mounting base plate structure for a refrigerator unit in accordance with the present invention as follows:

Pultrusion is a closed reactive process in which reinforcement materials comprising reinforcing fibers such as glass fibers, carbon fibers, aramid fibers, and polyester fibers can be used. The forms of the fiber reinforcement material can include for example rovings (tows, for carbon fiber), stitched rovings in different orientations, continuous strand mat, chopped strand mat, woven rovings, and bulk rovings. The fibers are pulled from a series of creels through an injection box, where the fibers are thoroughly mixed (impregnated) with a polyurethane resin or another typical resin useful in a pultrusion process. The other resins useful in the present invention can include for example a resin selected from the group consisting of polyesters, vinyl esters, PVC, epoxies, phenolics, urethanes and blends thereof.

Once the reinforcing fibers are impregnated with the resin, the impregnated resin/fiber material is passed through a heated steel die. The steel die is heated generally to a temperature range from about 80° C. to about 150° C. In the heated steel die, the resin matrix is shaped to the desired structure such as the shape of the compressor mounting base plate structure shown in FIGS. 6, 6A-6C and 7-12; and then the shaped structure is cured to form a "profile". The profile is continually pulled through the die until the profile exits the die. Upon exiting the die, the profile is cooled and then cut to the desired length which can be generally in the range of from 200 mm to about 750 mm.

The invention claimed is:

1. An elongated non-metal, corrosion resistant compressor mounting base plate structure comprising:

(I) a base plate segment having a top surface and a bottom surface, wherein the base plate segment is rectangular in shape forming two elongated sides opposite each other and two transverse sides opposite each other; and wherein the base plate segment is adapted for receiving a compressor on the top surface of the base plate;

(II) a means for receiving and removably affixing a compressor to the top surface of the base plate segment; and (III) at least one reinforcement means integral with said base plate segment; wherein said at least one reinforcement means includes at least two elongated longitudinal channel reinforcement members integral with the base plate segment, one channel reinforcement member at each of the elongated longitudinal sides of the base plate segment; said reinforcement means being adapted for providing the compressor mounting base plate structure with sufficient strength and rigidity such that the compressor mounting base plate structure can withstand deformation a load from the weight of the compressor; and wherein the compressor mounting base plate structure comprises a non-metal, corrosion resistant structure, (a) wherein the base plate segment comprises a central base plate segment; wherein the base plate segment comprises a planar member having a top surface and a bottom surface; wherein the base plate segment is adapted for receiving a compressor via one or more orifices, and wherein the base plate segment is adapted for receiving a means for mounting/affixing a compressor to the top surface of the base plate segment; (b) wherein the means for receiving and removably affixing a compressor to the top surface of the base plate segment comprises one or more orifices in the base plate segment adapted for receiving therethrough a threaded bolt and a threaded nut for engaging and locking with the threaded bolt sufficient to secure the compressor on the base plate via support mounting brackets attached to the compressor; and (c) wherein the at least one structural reinforcement means comprises at least a first and second elongated longitudinal channel reinforcement members integral with the base plate segment, one channel reinforcement segment integrally connected to each of the elongated longitudinal sides of the base plate segment, wherein the first elongated longitudinal channel reinforcement member and the second elongated longitudinal channel reinforcement member, each comprises an elongated longitudinal top ledge portion, an elongated longitudinal vertical sidewall portion, and an elongated longitudinal bottom ledge portion integral with each other forming a C-shaped elongated longitudinal channel member when viewed in an end cross-sectional view; and wherein the first and second channel reinforcement members are disposed integrally with the base plate segment; said first and second channel reinforcement members disposed on each side of the longitudinal length of the base plate segment such that the first and second channel reinforcement members are disposed parallel to each other on opposite sides of the longitudinal length of the base plate segment; wherein the first channel reinforcement member on one longitudinal side of the base plate segment comprises a forward facing C-shaped channel member when viewed in an end cross-sectional view; and wherein the second channel reinforcement member on the other longitudinal side of the base plate segment comprises a backward facing C-shaped channel member in mirror image to the first channel reinforcement member.

2. The compressor mounting base plate structure of claim 1, including further (IV) a first supplemental structural reinforcement means comprising at least a first and second supplemental reinforcing structure members integrally connected to the base plate segment, one supplemental reinforcing structure member at each transverse end of the transverse sides of the base plate segment opposite each other in mirror image and parallel to each other along the transverse plane of the base plate; and wherein the at least first and second supplemental reinforcing structure members are disposed transverse to the horizontal plane of the base plate segment at the extreme transverse ends of the base plate segment.

3. The compressor mounting base plate structure of claim 2, including further (V) a second supplemental structural reinforcement means comprising at least a third and fourth supplemental reinforcing structure members integrally connected to the base plate segment; said second supplemental structural reinforcement means adapted for (i) contributing to the reinforcement of the compressor mounting base plate structure, and (ii) receiving and removably affixing a means for moving the compressor mounting base plate structure.

4. The compressor mounting base plate structure of claim 3, wherein the at least third and fourth supplemental reinforcing members being disposed transverse to the horizontal plane of the base plate segment at the extreme transverse ends of the base plate segment; wherein the third supplemental reinforcing member is disposed in-between one transverse side of the base plate segment and the first supplemental reinforcing member; and wherein the fourth supplemental reinforcing member is disposed in-between the other transverse side of the base plate segment and the second supplemental reinforcing member.

5. The compressor mounting base plate structure of claim 1, including at least one load bearing/load distributing structure integral with the compressor mounting base plate structure and adapted for providing strength, reinforcement and integrity to the mounting base plate structure; wherein the at least one load bearing/load distributing structure is a raised surface area in at least a portion of the base plate segment adapted for receiving a compressor.

6. The compressor mounting base plate structure of claim 1, including a drip tray member removably attached to the top surface of the base plate segment, said drip tray member adapted for collecting moisture and condensation.

7. The compressor mounting base plate structure of claim 1, including a structure means integral with the base plate for removably attaching a means for moving an appliance unit once the compressor mounting base plate structure is affixed to the appliance unit; wherein said means for moving an appliance unit is also adapted for moving the compressor mounting base plate structure to and from the appliance unit during installation of the compressor mounting base plate structure to the appliance unit; and wherein said means for moving an appliance unit comprises at least one or more wheel members removably attached to base plate segment.

8. The compressor mounting base plate structure of claim 1, including a means for attaching the compressor mounting base plate structure to an appliance unit.

9. A process for manufacturing a compressor mounting base plate structure composite comprising subjecting a composite material to a pultrusion process to form the compressor mounting base plate structure of claim 1.

10. An appliance unit comprising a compressor mounting base plate structure of claim 1.

11. An appliance unit of claim 10, wherein the appliance unit is a refrigerator.

12. A refrigerator comprising (a) a refrigerator main body having a cooling chamber for storing foods and a machine compartment;

(b) a compressor mounting base plate structure of claim 1 installed in the machine compartment of the refrigerator main body; said compressor mounting base plate structure adapted for receiving and supporting a compressor; and (c) a compressor mounted on the compressor mounting base plate structure.

* * * * *